United States Patent [19]

Bradley et al.

[11] Patent Number: 5,071,062

[45] Date of Patent: Dec. 10, 1991

[54] REDUCIBLE CARTON FOR PIZZA PIES AND THE LIKE

[76] Inventors: David E. Bradley; Michael A. Jaworski, both c/o Packaging Concepts Corporation, 1737 Woodburn Dr., Hagerstown, Md. 21740

[21] Appl. No.: 646,014

[22] Filed: Jan. 28, 1991

[51] Int. Cl.[5] ..... B65D 5/24

[52] U.S. Cl. ..... 229/109; 229/101; 229/103

[58] Field of Search ..... 229/101, 103, 109, 117.01, 229/901, 902; 206/602, 604; 426/107

[56] References Cited

U.S. PATENT DOCUMENTS

| | | | |
|---|---|---|---|
| 2,251,565 | 8/1941 | Forman . | |
| 2,942,770 | 6/1960 | Eichorn | 229/101 |
| 3,043,487 | 7/1962 | Fowle | 229/101 |
| 3,310,220 | 3/1967 | Feldman | 229/101 |
| 3,371,842 | 3/1968 | Hechtmann . | |
| 3,580,476 | 5/1971 | Cannon | 229/902 |
| 3,598,303 | 8/1971 | Folz . | |
| 3,727,827 | 4/1973 | Stice . | |
| 4,328,923 | 5/1982 | Graser | 229/101 |
| 4,441,626 | 4/1984 | Hall | 229/902 |
| 4,452,367 | 6/1984 | Wein | 206/602 |
| 4,641,005 | 2/1987 | Seiferth . | |
| 4,765,534 | 8/1988 | Zion . | |
| 4,785,160 | 11/1988 | Hart | 426/107 |
| 4,841,112 | 6/1989 | Peleg | 426/107 |
| 4,851,632 | 7/1989 | Kaliski | 206/422 |
| 4,866,232 | 9/1989 | Stone | 426/107 |
| 4,891,482 | 1/1990 | Jaeger et al. | 426/107 |
| 4,937,410 | 6/1990 | Anderson | 229/DIG. 3 |
| 4,950,859 | 8/1990 | Anderson | 229/DIG. 3 |

*Primary Examiner*—Stephen Marcus
*Assistant Examiner*—Chris McDonald
*Attorney, Agent, or Firm*—Cushman, Darby & Cushman

[57] ABSTRACT

A box having a full size configuration and a reduced size configuration is provided. The full size box can hold, for example, an entire pizza. When the full volume is no longer required, the box can be reduced in size by eliminating certain portions thereof by tearing along preformed perforated score lines and folding along specially provided score lines. In accordance with the invention, no tools are required to form the smaller size box from the blank of the full size box. A microwave susceptor material can be provided on the base of the box to crispen leftovers that are heated in a microwave oven.

23 Claims, 2 Drawing Sheets

REDUCIBLE CARTON FOR PIZZA PIES AND THE LIKE

BACKGROUND OF THE INVENTION

1. Field of the Invention

The present invention relates to food containers and, in particular, a foldable one piece box for packaging relatively flat food products such as pizza pies and the like The invention further relates to a container particularly suited for storing and/or reheating leftovers.

2. Description of the Related art

Cartons for packaging flat food products such as tarts, cakes, and pies are well known and are provided in a number of shapes and sizes. Typically, flat food product cartons are formed from a single blank which is cut and scored so that it can be folded to define a three dimensional container. Many cartons are cut and scored so as to define a substantially square carton which is sized to accommodate the entire product, for example an entire pizza pie having a particular diameter. Other cartons, which are formed particularly for round food products such as pizza pies, are octagonal in shape so as to closely approximate the shape of the food product to thereby minimize displacement during transport and to provide corners having improved crush resistance. Such an octagonal carton is disclosed for example in U.S. Pat. No. 4,765,534.

Rectangular and octagonal cartons of the type described above are most commonly used by home delivery pizza services and restaurants which offer carry-out services. Such businesses and are enjoying ever increasing popularity and thus there has been an increased desire to provide boxes or cartons which better serve the needs of the home delivery or carry-out customer.

As noted above, food cartons such as pizza boxes are necessarily configured so as to accommodate an entire, generally large size, product such as an entire pizza pie. However, an entire pie, even a pizza pie, is not ordinarily consumed in -one sitting. The consumer must then store the "leftovers" in the refrigerator for later consumption. Because the original, large size box is no longer required for the relatively small remaining portion of the pizza pie, and because the full size box will occupy a great deal of valuable space in the refrigerator, typically the leftover pizza pie is wrapped in plastic wrap or aluminum foil and then stored in the refrigerator.

A further disadvantage of full size pizza boxes is that they typically can not be received within a microwave oven. Likewise, plastic wrap and aluminum foil are inappropriate containers for microwave heating. Therefore, typically a plate must be dirtied when reheating pizza leftovers.

Yet another problem with conventional boxes is that, even if they are of a size which can be accommodated in a microwave oven, when a product such as a pizza pie is heated in a microwave oven, the crust will become soft and chewy.

SUMMARY OF THE INVENTION

It would be desirable to provide a box or carton for flat food products, such as pizza pies, which can be reduced to a smaller size once the full volume thereof is no longer required so as to be better suited for containing the leftover portion of the food product. Such a smaller container allows the leftovers to be stored within the original box in the refrigerator without occupying a great deal of space. Furthermore, use of the reduced size box for storing the leftovers eliminates the requirement for plastic wrap or aluminum foil which will in turn conserve resources and minimize solid waste. Even or home delivery company's logo on the outer surface of the box, the consumer will be reminded of the origin of the food product, which will encourage patronage in the future.

Accordingly, it is an object of the present invention to provide a box which can be advantageously used as a full sized carton or box for containing, for example, an entire pizza pie and which, once a portion of the contents has been consumed, can be easily reduced in size without requiring the use of any cutting tools so as to provide a reduced size container for the leftovers which can be easily stored in the refrigerator.

It would even further be desirable to provide a microwave susceptor material on at least a portion of the bottom inside surface of a box of the type used to transport and/or store pizza or the like so that upon reheating in a microwave oven, the pie crust will be crispened.

Thus, it is a further object of the invention to provide a container which, particularly in its reduced size, can be advantageously placed within a microwave oven for reheating the leftover food product disposed therein.

In accordance with the invention, then, a full size pizza box is provided which, when a larger volume is no longer required, can be reduced in size by eliminating certain portions of the box by tearing along preformed perforated score lines and folding along specially provided score lines. In accordance with the invention, advantageously, no tools are required to form the smaller size box from the blank of the full size box.

Furthermore, in accordance with the invention a microwave susceptor material is provided on at least a portion of the bottom of the box so that when a food product is heated while in the box and within a microwave oven, the exterior surface of at least a part of that product will be crispened.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Foldable boxes or cartons for flat food products such as pizza pies, as noted above, are typically formed as a flat blank which is provided with a number of score lines which allow the side walls, end walls and interlocking portions of the box to be formed. As used herein, score line encompasses any line provided on a paperboard or cardboard blank for allowing the same to be folded in a predetermined fashion. Thus, score line encompasses a preformed fold line which is free from perforations, partially perforated, or fully perforated. Providing perforations along a fold line facilitates folding certain portions of the blank, particularly where the blank is formed from corrugated cardboard. Where thinner cardboard is used for the blank, performed fold lines which are free from perforations are generally sufficient to allow folding as desired. Perforations also facilitate removal of one or more portions of the box blank. As described more particularly below, in accordance with the invention, some of the score lines are lines of weakness along which the box can be torn so that portions of the full size box blank can be easily removed. Such lines of weakness are preferably perforated lines, particularly where the box is formed from corrugated cardboard and thus, for convenience, are referred to hereinbelow as perforated score lines. However, cuts in and/or through the material of the blank need not necessarily be provided and perforated score line as used herein is intended to refer to any score line defining a line of weakness along which the material of the blank can be torn.

The concept of the invention can be applied to any one piece blank used to form a three dimensional food container. By way of example, a detailed description of two embodiments will be provided.

Figure 3:
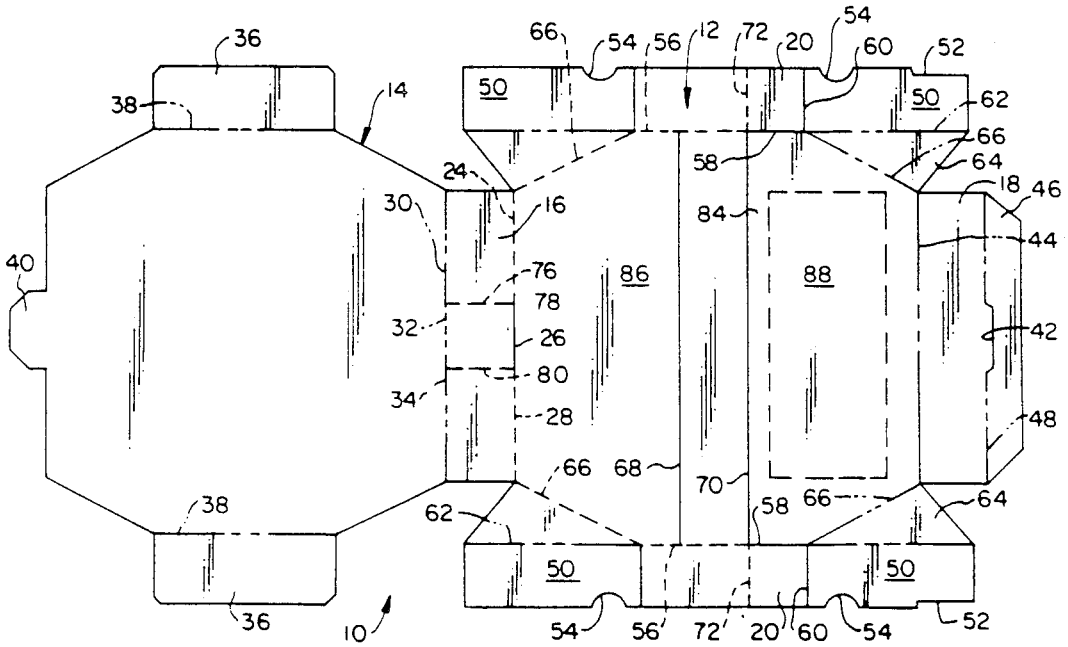
FIG. 3 is a top plan view of the blank for forming the box of FIGS. 1 and 2.

With reference to FIG. 3, a blank 10 for forming a octagonal box is shown. As can be seen, the blank 10 is prescored to define a base portion 12 for defining the bottom of the folded box, a top portion 14 for defining the lid of the folded box, a rear wall 16, a front wall 18, and first and second side walls 20. Further score lines are provided for folding in the corners of the box to reinforce the same. The blank is designed to be manually folded to enclose a generally circular pie type food product such as a pizza pie.

Figure 1:
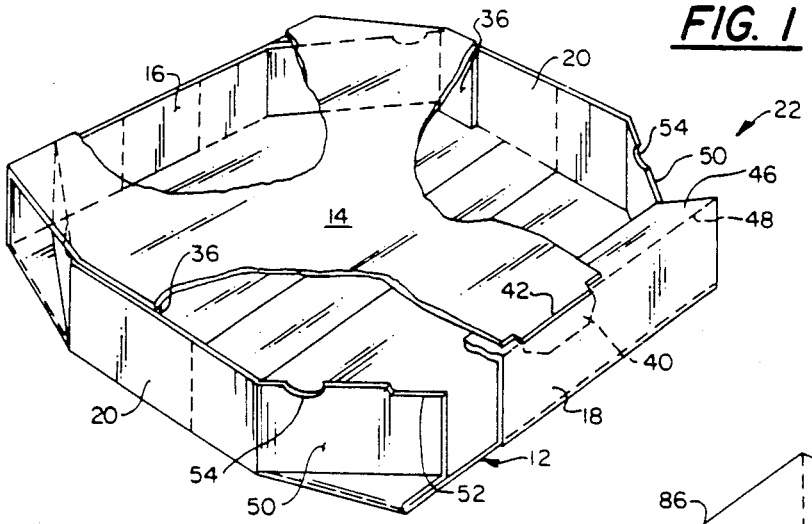
FIG. 1 is a perspective view of a box formed in accordance with the present invention in its full size configuration, with parts broken away for clarity.

The octagonal carton formed by folding the prescored blank of FIG. 3 is shown in FIG. 1 and designated generally by the reference number 22. The box is typically prefolded into the three dimensional configuration shown in FIG. 1 and the pizza pie (not shown) is received on the base portion thereof. If desired, a sheet of wax paper or the like can be placed on the bottom of the box to minimize the passage of grease and other moisture through the bottom of the box. In addition or in the alternative, as described more fully below, a film which is at least partially metalized to define a microwave susceptor can be provided on at least a portion of the base wall of the box. The film advantageously acts as a grease barrier and, when the box is placed in a microwave oven, either in its full configuration or its reduced size configuration (disclosed below), the metalized portion will crispen the crust of the portion of the pizza pie disposed thereon.

As shown in FIG. 3, the blank 10 is scored so that the rear wall 16 is hingedly coupled to the base portion 12 along score lines 24, 26, and 28, and is hingedly coupled to the top portion 14 along score lines 30, 32, and 34. The lid portion 14 is preferably provided with ears 36 which are hingedly coupled thereto respectively along score lines 38. When the box 22 is folded, as shown in FIG. 1, the ears 36 are respectively disposed adjacent to and on the inside of side walls 20 and prevent the lid from collapsing inwardly on the food product, maintain the box square and facilitate closure of the container to minimize heat loss during transport. Finally, a tongue 40 is hingedly coupled to the free end edge of the lid 14 for selectively engaging a slot 42 defined in the top edge of the front wall 18 of the box 22, as described more fully below.

The front wall 18 is hingedly coupled to the base portion 12 along score line 44 and a flap 46 is hingedly coupled to the front wall 18 along score line 48. Slit or slot 42 is defined along a portion of score line 48, substantially at the midpoint thereof. As shown in FIG. 1, when the box 22 is folded, the flap 46 is folded to extend inwardly of the box 22 and, when the lid 14 is to be closed, tongue 40 is inserted into slot 42. The tongue 40 is preferably tapered as shown to facilitate insertion.

The corner walls 50 of the front corners of the box are cut away as shown at 52 to define a seat for flap 46. One or more cutouts 54 are further provided, preferably in the corner walls 50, as shown, to allow escape of moist steam from the contained food product so that such moisture will not compromise the structural integrity of the box 22.

The side walls 20, which are mirror images of one another, are each hingedly coupled to the base portion along score lines 56, 58. The corner portions of the box are folded in to form diagonal corner walls 50 which in turn support the lid 14 or top wall of the finished box 22. The corners of the box are scored and cut so that the front corners are mirror images of one another and the front corners are mirror images of the rear corners. Accordingly, only one of the corners will be described in detail, the remaining corners being formed and folded in like fashion.

Each corner includes a corner wall portion 50 hingedly coupled to the end of the respective side wall 20 along score line 60. The bottom edge of corner wall 50 is hingedly coupled along score line 62 to a substantially triangular fold portion 64 which is in turn hingedly coupled along score line 66 to the base portion 12.

When the blank 10 is folded to form the box 22 shown in FIG. 1, the side walls 20 are folded up along respective score lines 56, 58 and the corner portions 50 are folded so that triangular portions 64 are folded along score lines 62 and 66 so as to lie substantially flat against the bottom wall 12. This results in the corner walls 50 being disposed substantially perpendicular to the base portion 12. To complete folding of the box 22, the front wall 18 is folded up against the corner portions along score line 44. Flap 46 is then folded along its respective score line 48 over the corner walls and onto seats 52, as mentioned above. The rear wall 16 is folded in a similar manner along score lines 24, 26, and 28 against the corner walls of the rear corner portions. Finally, the top portion 14 is folded down along score lines 30, 32, and 34 and the tongue 40 is inserted into slot 42, as was also mentioned above.

The walls of the thus erected carton 22 are designed to accommodate a pie of a particular diameter. Thus, different size cartons may be provided for accommodating pizzas of different sizes. It is envisioned that typically small, medium and large size boxes may be provided.

In accordance with the present invention, two further score lines 68, 70 are provided on the base or bottom wall portion 12 of the box blank 10. The two additional score lines 68, 70 are spaced apart a distance corresponding to the height of the rear wall 16 of box 22. The score lines 68, 70 may be preformed fold lines or may be perforated score lines. It is noteworthy that providing a score line where the material has not been cut through for score lines 68 and 70 will advantageously minimize leakage of, for example, grease through the bottom wall of the box in use. Furthermore, in accordance with the invention at least one perforated score 72 line is defined widthwise of each longitudinal side wall 20.

In order to form a box 74 of reduced size in accordance with the present invention, the blank 10 is torn along perforated score lines 72 in the side walls 20 and along perforated score lines 56 and along perforated score lines 66 in the rear corner portions. In accordance with one form of the invention, the lid 14 is then removed along perforated score lines 30, 32, and 34 and the remaining flap which originally defined the rear wall 16 of the box can be disposed adjacent the front wall 18 of the box 74 when the lid of the box is closed. In the alternative, two further perforated score lines 76, 80 can be defined in the rear wall 16 and by tearing along perforated score lines 24, 76, 32, 80, and 28, a tab element 78 is defined in the carton blank which can be inserted into slot 42 to thereby hold the reduced size box 74 in its closed configuration, as described more particularly below.

Figure 2:
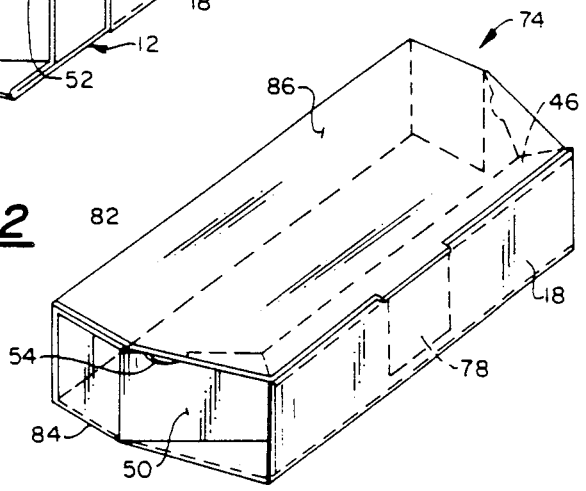
FIG. 2 is a perspective view of the box of FIG. 1 but with portions thereof removed in accordance with the present invention and the remaining portion refolded so as to provide a reduced size box in accordance with the invention.

To form the reduced size box 74, once the box blank 10 is torn as described above, the blank is folded along score line 70 and along score line 68 so that the mid portion of the base portion, identified with reference numeral 82, defines the vertical rear wall of the reduced box 74, end portion 84 of the base portion 12 defines the base of the reduced box 74 and end portion 86 of the base portion 12 defines the lid of the reduced box 74. The reduced box 74 thus formed is shown in FIG. 2, as shown, where the blank 10 is torn to define a tab element 78, that tab element is inserted into slot 42 (as shown in phantom in FIG. 2) to close the box.

In accordance with yet a further aspect of the present invention as schematically illustrated in FIG. 3, a microwave susceptor material 88 is provided on at least a portion of the bottom wall 12 of the carton or box 22. The susceptor material 88 can be attached to the base portion 12 of the box 22 in any suitable manner but is preferably separately formed as a film, for example a metalized polyester film, which is then laminated to the material from which the box blank 10 is cut. Such a film will also advantageously provide a grease barrier for the box bottom. Thus, for example where a microwave susceptor material is desired on the portion of the base which will be the base of the reduced size box 74, but where a grease barrier is desired for the bottom of the full size box 22, the film laminated to the base portion of the blank can be only partially metalized to thereby provide the dual functions noted above.

It is preferred, where the box is configured for tearing and folding to form a reduced size box, that the microwave susceptor material be provided solely on that portion 84 of the base portion which will ultimately carry the leftover food product. However, the microwave susceptor material can cover the entire base wall or a circular portion thereof so as to underlie the entire food product and thereby form a grease barrier for the fresh product and/or to crispen the crust of the entire pizza if the full size box is placed in a microwave oven.

Figure 4:
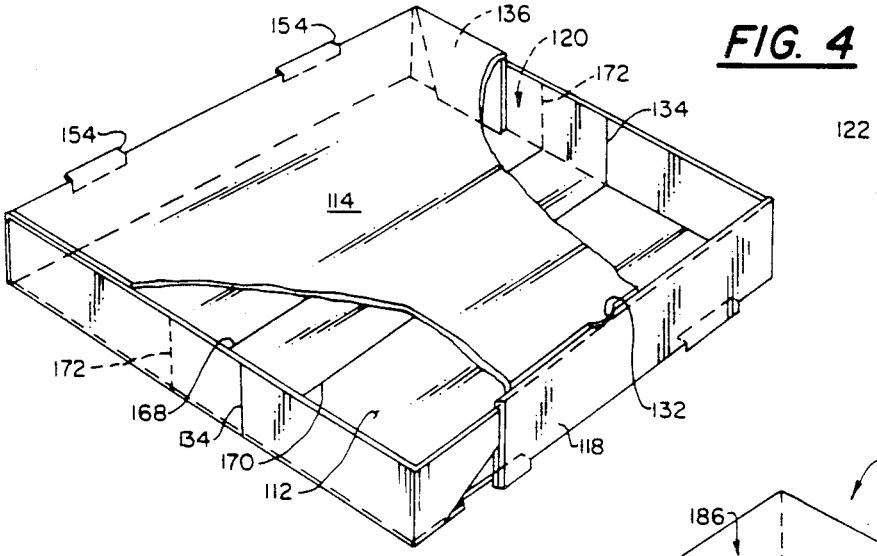
FIG. 4 is a perspective view of a another box formed in accordance with the present invention in its full size configuration, with parts broken away for clarity.
Figure 5:
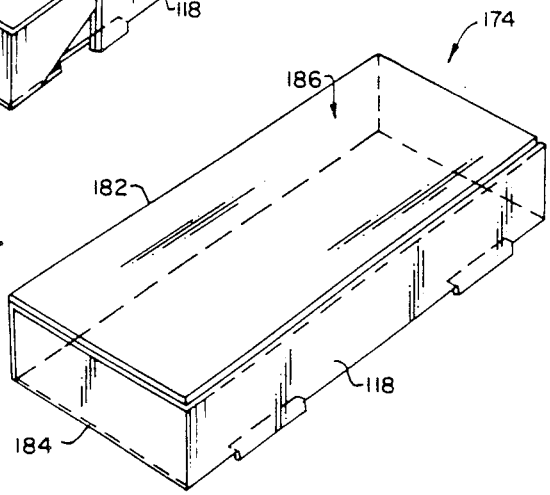
FIG. 5 is a perspective view of the box of FIG. 4 but with portions thereof removed in accordance with the present invention and the remaining portion refolded so as to provide a reduced size box in accordance with the invention.
Figure 6:
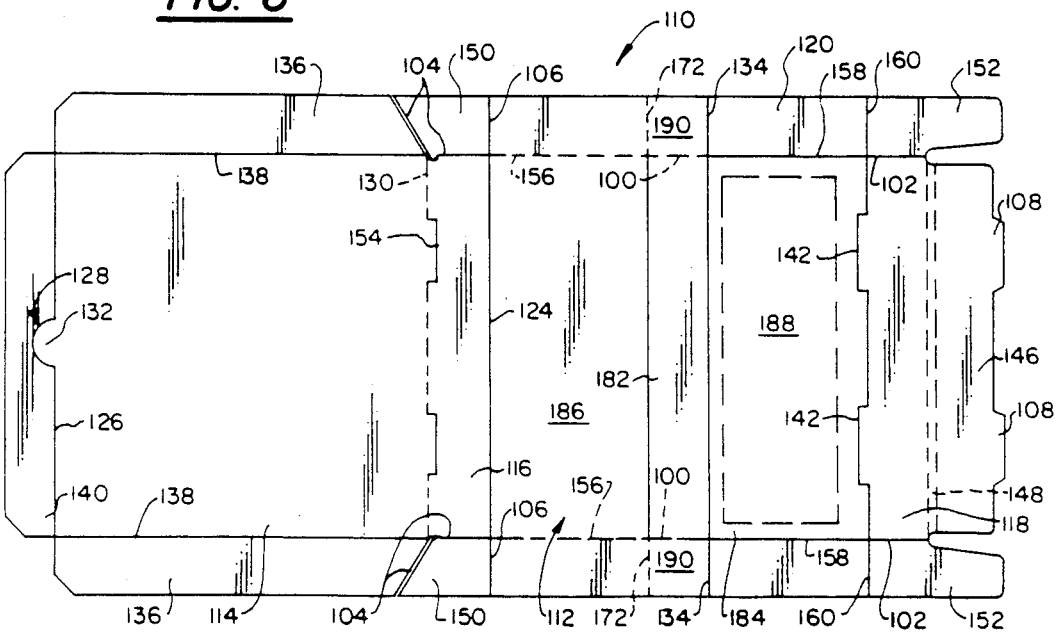
FIG. 6 is a top plan view of the blank for forming the box of FIGS. 4 and 5.

Another example of a carton or box for holding relatively flat food products such as pizza pies is illustrated in FIGS. 4–6. The box blank 110 which is shown in FIG. 6 is adapted to be folded along certain of the illustrated preformed score lines to form the full size, three dimensional carton or box 122 illustrated in FIG. 4. However, by tearing along certain of the score lines shown in FIG. 6 and folding along other of those score lines, a reduced size, three dimensional carton or box 174, which is shown in FIG. 5, can be formed. More particularly, box blank 110 includes a first portion 112 adapted to form the base of the full size box 122. First and second side walls 120 are respectively hingedly attached to base portion 112 along score lines 158, 100 and 156. A front tab 152 is defined at the forward longitudinal end of each side wall 120 by cut 102 and score line 160. Similarly, a rear tab 150 is defined at the rearward longitudinal end of each side wall by a cut 104 and score line 106.

The front wall 118 of the is hingedly coupled to the base portion along score line 144 which has two slots 142 defined therein, the purpose of which is described more fully below.

A fold over flap 146 is hingedly coupled along one edge thereof to the front wall 118 opposite the base portion 112 via a double score line 148. Double score line 148 facilitates folding of the fold over flap 146 as described below, particularly where the blank is of corrugated cardboard. A single score line may be sufficient, however, particularly where relatively thin cardboard is used for the box blank. Two tabs 108 are defined on the free edge of the fold over flap, the purpose of which is described more fully below.

The rear wall 116 is hingedly coupled to the base portion along score line 124 and to the top portion 114 along score line 130. Air vents 154 are defined by cuts in score line 130. In accordance with the illustrated embodiment, side flaps 136 are hingedly coupled along respective score lines 138 to the top portion 114. Finally, an end portion 140 is hingedly coupled along score line 126 to the top portion 114 to complete the lid of the full size box. A semi-circular cut 128 can further be provided along a portion of the edge of the top portion 114 and a corresponding portion of the score line 126 omitted to define a pull tab 132 for opening the lid, as shown in FIG. 4. As is further shown in FIGS. 4 and 6, the free corners of the side and end flaps can be cut off, to facilitate box closure, as will become more apparent below.

As an alternative to the illustrated configuration, the cover of the box may substantially correspond to that illustrated in FIG. 3 and described with reference thereto. That is having a pair of ears and a tongue for insertion in a corresponding slot defined along a portion of and between the double score line 148.

To form the full size box 122 of FIG. 4, the side walls are folded up along score lines 158, 100 and 156 and the front and rear tabs 152, 150 are each folded in along respective fold lines 160 and 106 so as to be substantially perpendicular to the plane of their respective side wall 120. The front wall 118 is then folded up along score line 144 and the fold over flap 146 is folded along double score line 148 so as to be flat against the front wall 118 and so that the front tabs 152 are captured between the flap 146 and the front wall 118. To retain the flap 146 in its folded over disposition, tabs 108 are inserted in the slots 142, which are correspondingly spaced.

The lid 114 is then folded so that the side and end flaps 136, 140 are folded up along their respective score lines 138, 126 and the pull tab 132 projects outwardly from the end flap. Finally, the blank is folded along score lines 124 and 130 and the end and side flaps 140, 136 are inserted adjacent and inside the front and side walls 118, 120, respectively, to close the box 122, as shown in FIG. 4. The pull tab 132 projects forwardly of the front wall and thus can easily be grasped by the consumer to open the box.

In accordance with the present invention, first and second score lines 168, 170 are defined across a mid portion of the bottom face of the box. The score lines are spaced apart a distance substantially corresponding to the spacing of the score lines defining the rearward end wall 116 of the box. Score lines 168, 170 thus define a mid portion 182 and end portions 184, 186 of the base a portion 112 of the box blank 110. The score lines 168, 170 may be preformed fold lines or may be line where the material has not been cut through for score lines 168 and 170 will advantageously minimize leakage of, for example, grease through the bottom wall of the box in use. Furthermore, in accordance with this embodiment, two score lines 172, 134 are defined widthwise of each longitudinal side wall 120, at least one of which is a perforated score line.

In order to form a box of reduced size in accordance with the present invention, the blank 110 is torn along perforated score lines 172 in the side walls 120 along perforated score lines 100 and along score lines 106. In accordance with one form of the invention, the lid is then removed along perforated score line 130 and the remaining flap which originally defined the rear wall 116 of the box 122 can ultimately be disposed inside and adjacent the front wall 118 of the box 174 when the lid 186 of the box 174 is closed. In the alternative, two further perforated score lines (not shown) can be defined in the rear wall 116 of the box, as was illustrated in FIG. 3 and described with reference thereto.

The newly defined flaps 190 can then be folded in along score lines 134 to define rear flaps. The blank is next folded along score lines 168 and 170 so that the mid portion 182 of the base portion defines the vertical rear wall of the reduced box 174, end portion 184 of the base. portion defines the base of the reduced box and end portion 186 of the base portion defines the lid of the reduced box. Further, the newly defined rear flaps 190 lie adjacent the thus folded up mid portion 182, as original rear flaps 150 lay adjacent rear wall 116. In the alternative, score line 134 can be a perforated score line and the blank 110 can be torn along that score line to entirely remove that portion of the blank. As yet a further alternative, the blank can be torn along score line 134 and folded along line 172. In the presently preferred form, the blank 110 is torn along score lines 172, 100 and 134. The reduced box thus formed is shown in FIG. 5.

In accordance with yet a further aspect of the present invention, as schematically illustrated in FIG. 6, a microwave susceptor material 188 is provided on at least a portion of the bottom wall of the carton or box. The susceptor material 188 can be attached to the base portion of the box in any suitable manner but is preferably separately formed as a film, for example a metalized polyester film, which is then laminated to the material from which the box blank is cut. As noted above, such a film will also advantageously provide a grease barrier for the box bottom. Thus, where a microwave susceptor material is desired solely on that portion of the base portion which will be the bottom of the reduced size box, but a grease barrier is desired for the bottom of the full size box, the film laminated to the base portion of the blank can be only partially metalized to thereby provide the dual functions noted above.

It is preferred, where the box is configured for tearing and folding to form a reduced size box, that the microwave susceptor material be provided solely on that portion of the base portion which will ultimately carry the leftover food product. However, the microwave susceptor material can cover the entire base wall or a circular portion thereof so as to underlie the entire food product and thereby form a grease barrier for the fresh product and/or to crispen the crust of the entire oven.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A box for flat food products comprising a one-piece blank prescored to define a base portion, a rear end wall hingedly coupled along one longitudinal side edge thereof to a rear edge of said base portion, a top portion hingedly coupled along a rear edge thereof to the other longitudinal side edge of said rear end wall, a pair of side walls each hingedly coupled along one longitudinal side edge thereof to a respective longitudinal side edge of said base portion, a front end wall hingedly coupled along a longitudinal side edge thereof to a front edge of one of said base portion and said top portion, said blank further having first and second transverse score lines defined on said base portion and extending between said longitudinal side edges of said base portion, said score lines being spaced apart a distance substantially corresponding to a height of said rear wall, whereby when at least said top portion is removed and said blank is folded along each of said first and second transverse score lines, a box of reduced size for flat food products of reduced size having a lid and a base will be formed.

2. A box as in claim 1, further comprising at least one score line defined on each said side wall, each said score line being in a plane of one of said transverse core lines.

3. A box as in claim 2, wherein two score lines are defined on each said side wall, at least one of said two score lines being a perforated score line.

4. A box as in claim 1, wherein each of said side walls has foldable flap means at opposite ends thereof free from connection to said front wall and rear wall.

5. A box as in claim 4, wherein each said foldable flap means includes a corner wall portion hingedly coupled to said side wall and a substantially triangular portion hingedly coupled on one side edge thereof to said side wall, hingedly coupled on another side edge thereof to said base portion and having a free third side edge, whereby said blank can be folded so that each said triangular portion is disposed substantially flush against said base portion and each said corner wall portion is disposed substantially perpendicular with respect to said base portion to thereby define substantially diagonal corners.

6. A box as in claim 5, wherein said top portion has eight side edges.

7. A box as in claim 1, wherein said top portion has at least four side edges.

8. A box as in claim 5, wherein said base portion has eight side edges.

9. A box as in claim 1, wherein said base portion has four side edges.

10. A box as in claim 1, wherein said front wall is hingedly coupled along one longitudinal side edge to said base portion, a flap member is hingedly coupled to the other longitudinal side edge of said front wall via a score line which has a slit defined therethrough along at least a portion of the length thereof, and wherein a tongue element is hingedly coupled to a free end edge of said top portion and sided so as to be insertable into said slit.

11. A box as in claim 10, wherein each of said side walls has foldable flap means at opposite ends thereof free from connection to said front wall and rear wall, each said foldable flap means including a corner wall portion hingedly coupled to said side wall and a substantially triangular portion hingedly coupled on one side edge thereof to said side wall, hingedly coupled on another side edge thereof to said base portion and having a free third side edge, whereby said blank can be folded so that each said triangular portion is disposed substantially flush against said base portion and each said corner wall portion is disposed substantially perpendicular with respect to said base portion to thereby define substantially diagonal corners.

12. A box as in claim 11, wherein said corner wall portions adjacent said front wall have cutout portions having a depth coresponding to a thickness of said flap member.

13. A box as in claim 1, wherein said blank is formed from corrugated cardboard.

14. A box as in claim 1, further comprising a microwave susceptor material on at least a portion of said base portion.

15. A box as in claim 14, wherein said susceptor material is disposed between one of said transverse score lines and said front edge of said base portion.

16. A box as in claim 4, wherein at least one of said side walls, said rear wall and said foldable flap means includes means defining a vent for allowing the escape of steam from the interior of the box.

17. A box as in claim 1, wherein a flap element is hingedly coupled to each side edge of said top portion, said flap elements being adapted to be disposed in side and adjacent said side walls.

18. A box as in claim 1, wherein a flap element is hingedly coupled to a front side edge of said top portion, said flap element being adapted to be disposed adjacent said front wall.

19. A box as in claim 1, further comprising first and second perforated score lines on said rear wall, extending between said base portion and said top portion.

20. A box as in claim 1, wherein said top portion is hingedly coupled to said rear end wall along a score line which is at least partially perforated so as to facilitate removal of said top portion from said rear end wall along at least said perforated portion of said score line.

21. A method of forming a reducible box comprising:

cutting and scoring a one-piece blank to define a base portion, a rear end wall hingedly coupled along one longitudinal side edge thereof to a rear edge of said base portion, a top portion hingedly coupled along a rear edge thereof to the other longitudinal side edge of said rear end wall, a pair of side walls each hingedly coupled along one longitudinal side edge thereof to a respective longitudinal side edge of said base portion, a front end wall hingedly coupled along a longitudinal side edge thereof to a front edge of one of said base portion and said top portion; and forming two further transverse score lines on said base portion, so that said transverse score lines are spaced apart a distance substantially corresponding to a height of said rear wall, whereby when at least said top portion is removed and said blank is folded along each of said first and second transverse score lines, a box of reduced size for flat food products of reduced size having a lid and a base will be formed.

22. A method as in claim 21, further comprising forming at least one further score line on each said side wall, each said score line being in a plane of one of said transverse score lines.

23. A method as in claim 22, wherein two further score lines are formed on each said side wall, at least one of said two score lines being a perforated score line.

* * * * *